US010107173B2

(12) United States Patent
Jyouzaki et al.

(10) Patent No.: US 10,107,173 B2
(45) Date of Patent: Oct. 23, 2018

(54) STRADDLE-TYPE VEHICLE

(71) Applicant: KAWASAKI JUKOGYO KABUSHIKI KAISHA, Kobe-shi, Hyogo (JP)

(72) Inventors: Takahiro Jyouzaki, Akashi (JP); Akira Soeda, Kobe (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 0 days.

(21) Appl. No.: 15/621,611

(22) Filed: Jun. 13, 2017

(65) Prior Publication Data

US 2018/0030879 A1 Feb. 1, 2018

(30) Foreign Application Priority Data

Jul. 28, 2016 (JP) ..... 2016-148012

(51) Int. Cl.
*F01P 3/02* (2006.01)
*F01P 7/16* (2006.01)
*F01P 11/04* (2006.01)

(52) U.S. Cl.
CPC ..... *F01P 3/02* (2013.01); *F01P 7/16* (2013.01); *F01P 11/04* (2013.01); *F01P 2003/028* (2013.01); *F01P 2050/16* (2013.01)

(58) Field of Classification Search
CPC .... F02M 55/02; F02M 55/025; F02M 35/104; F02M 2000/185; B60K 15/01
See application file for complete search history.

(56) References Cited

U.S. PATENT DOCUMENTS 7,430,993 B2 * 10/2008 Yasui ..... F01P 3/02 123/41.44
7,921,829 B2 * 4/2011 Hayashi ..... F01P 3/02 123/41.31
8,118,001 B2 * 2/2012 Kowada ..... F01P 11/029 123/196 AB
9,266,421 B2 * 2/2016 Sugiura ..... B60K 11/02
9,482,143 B2 * 11/2016 Inayama ..... B60K 11/04
9,988,978 B2 * 6/2018 Oda ..... F01M 1/00
(Continued)

FOREIGN PATENT DOCUMENTS

JP 2014227923 A 12/2014

*Primary Examiner* — David Hamaoui
*Assistant Examiner* — Kody Kight
(74) *Attorney, Agent, or Firm* — Alleman Hall Creasman & Tuttle LLP

(57) ABSTRACT

A straddle-type vehicle includes a radiator; an engine; and a passage which is provided inside the cylinder block and the cylinder head, flows a coolant from the cylinder head toward the cylinder block, and is provided with an inlet located on a rear side of the cylinder head; a pipe which flows the coolant from the radiator toward the passage, and flows the coolant from an outlet toward the radiator; and a thermostat which limits a flow of the coolant inside the pipe in a case where a temperature of the coolant is equal to or lower than a predetermined temperature, and permits the flow of the coolant in a case where the temperature is higher than the predetermined temperature, wherein the outlet is provided on a front side of the cylinder block and the thermostat is attached on a front portion of the engine.

9 Claims, 5 Drawing Sheets

(56) References Cited

U.S. PATENT DOCUMENTS

2005/0183676 A1* 8/2005 Takano ..... F01P 7/16 123/41.1
2005/0263110 A1* 12/2005 Yasui ..... F01P 3/02 123/41.72
2006/0065218 A1* 3/2006 Gokan ..... F01M 5/007 123/41.82 R
2007/0157893 A1* 7/2007 Wei ..... F01P 3/02 123/41.08
2007/0204828 A1* 9/2007 Nagahashi ..... F01M 11/02 123/192.2
2008/0053385 A1* 3/2008 Negoro ..... F01P 11/0285 123/41.31
2009/0114171 A1* 5/2009 Hayashi ..... F01P 3/02 123/41.44
2009/0255489 A1* 10/2009 Fujiwara ..... F01P 11/04 123/41.57
2011/0114044 A1* 5/2011 Dees ..... F02F 1/40 123/41.82 R
2013/0118721 A1* 5/2013 Inoue ..... F01P 3/18 165/148
2013/0125843 A1* 5/2013 Fukuoka ..... F01P 3/02 123/41.1
2013/0256044 A1* 10/2013 Sugiura ..... B60K 11/02 180/68.1
2014/0026832 A1* 1/2014 Yamashiro ..... F01P 3/02 123/41.08
2014/0060465 A1* 3/2014 Iida ..... F02B 61/02 123/41.47
2014/0345548 A1* 11/2014 Miura ..... F01P 3/12 123/41.08
2015/0144078 A1* 5/2015 Hutchins ..... F01P 7/165 123/41.1
2015/0184576 A1* 7/2015 Yi ..... F01P 3/02 123/41.09
2016/0177807 A1* 6/2016 Tanaka ..... F01P 3/18 123/41.01
2016/0273482 A1* 9/2016 Yamada ..... F01P 3/02

* cited by examiner

STRADDLE-TYPE VEHICLE

CROSS-REFERENCE TO THE RELATED APPLICATION

This application claims priority to and the benefit of Japanese Patent Application No. 2016-148012 filed on Jul. 28, 2016, the entire disclosure of which is incorporated herein by reference.

BACKGROUND OF THE INVENTION

Field of the Invention

The present invention relates to a straddle-type vehicle such as a motorcycle.

Description of the Related Art

As disclosed in Japanese Laid-Open Patent Application Publication No. 2014-227923, a straddle-type vehicle such as a motorcycle is provided with a pipe structure for circulating a coolant between a radiator and an engine via a thermostat.

SUMMARY OF THE INVENTION

An object of the present invention is to provide a pipe structure for circulating a coolant between a radiator and an engine via a thermostat so that design flexibility can be easily improved and the external appearance of a straddle-type vehicle can be easily maintained, in the straddle-type vehicle provided with the pipe structure.

According to an aspect of the present invention, a straddle-type vehicle comprises: a radiator through which a coolant flows; an engine which generates driving power for allowing the straddle-type vehicle to travel, the engine including: a cylinder block; a cylinder head disposed above the cylinder block; and a passage which is provided inside the cylinder block and the cylinder head and flows the coolant from the cylinder head toward the cylinder block, the passage being provided with an inlet located at a rear side of the cylinder head; a pipe which flows the coolant from the radiator toward the inlet of the passage, and flows the coolant from an outlet of the passage toward the radiator; and a thermostat which limits a flow of the coolant inside the pipe in a case where a temperature of the coolant is equal to or lower than a predetermined temperature, and permits the flow of the coolant inside the pipe in a case where the temperature of the coolant is higher than the predetermined temperature, wherein the outlet of the passage is provided on a front side of the cylinder block and the thermostat is attached on a front portion of the engine.

In accordance with this configuration, since the outlet of the passage is located on the front side of the cylinder block, and the thermostat is attached on the front portion of the engine, it is not necessary to increase the length of the pipe connecting the thermostat to the outlet of the passage, on the front side of the cylinder block. In this way, a pipe structure can be simplified. As a result, it becomes possible to easily improve design flexibility of the straddle-type vehicle, and easily maintain the external appearance of the front side of the cylinder block.

Since the thermostat is attached on the front portion of the engine, and the thermostat and the pipe are disposed below the upper end of the engine, the thermostat and the pipe are not easily seen from the outside region of the straddle-type vehicle. This makes it possible to easily maintain the external appearance of the straddle-type vehicle, when viewed from above.

The straddle-type vehicle may further comprise: an exhaust pipe which is connected to the front portion of the engine and extends downward to a location that is below the engine, from a front surface of the cylinder block, when viewed from a front, the thermostat may include a valving element, and a case which accommodates the valving element therein, the thermostat may be disposed between the cylinder block and the exhaust pipe, and a first end of the case of the thermostat may be connected to the pipe, and a second end of the case of the thermostat is connected to the outlet of the passage.

In accordance with this configuration, since the thermostat is disposed between the cylinder block and the exhaust pipe, and the first end of the case accommodating the valving element of the thermostat is connected to the pipe, and the second end of the case is connected to the outlet of the passage, the thermostat can be placed close to the outlet of the passage, and thus a space in which the thermostat is disposed can be saved. In addition, the case of the thermostat and the outlet of the passage can be connected to each other without use of a pipe. As a result, the pipe structure can be further simplified.

The case of the thermostat may extend in a direction crossing a forward and rearward direction of a vehicle body of the straddle-type vehicle, from the front side of the cylinder block. In accordance with this configuration, since the case of the thermostat extends in the direction crossing the forward and rearward direction of the vehicle body of the straddle-type vehicle, from the front side of the cylinder block, the amount of the protruding portion of the case of the thermostat which protrudes forward from the engine can be reduced, and a space formed in front of the engine can be easily secured. In addition, without a need to bend the pipe to a great degree, the pipe can be extended in the direction crossing the forward and rearward direction, from the thermostat. Therefore, the pipe structure can be easily simplified.

The engine may be a multi-cylinder engine including a plurality of cylinders aligned in a specified direction, the inlet of the passage and the outlet of the passage may be disposed at a center of the engine in the specified direction, and the passage may extend from the inlet to a first side in the specified direction and to a second side in the specified direction, and extend from the outlet to the first side and to the second side, inside the engine.

In accordance with this configuration, since the inlet of the passage and the outlet of the passage are disposed at the center of the engine in the specified direction, and the passage extends from the inlet to the first side in the specified direction and to the second side in the specified direction, and extends from the outlet to the first side and to the second side, inside the engine, the plurality of cylinders can be cooled uniformly by the coolant which flows into the engine through the inlet of the passage and is discharged to the outside of the engine through the outlet of the passage. In this way, the pipe structure can be simplified, and uniform cooling effects for the cylinders can be obtained.

The straddle-type vehicle may further comprise a temperature sensor which detects a temperature of the coolant flowing through the passage provided inside the cylinder block, and the temperature sensor may be attached on a rear portion of the cylinder block.

In accordance with this configuration, since the temperature sensor is attached on the rear portion of the cylinder block, the temperature of the coolant flowing through the passage can be detected with high accuracy, while reducing a variation in the detection value of the temperature sensor, which occurs due to the air contacting the front portion of the engine, or the temperature of the coolant which has just flowed into the inlet of the passage. This makes it possible to properly detect the temperature state of the engine.

The temperature sensor is attached on the rear portion of the cylinder block which is a side opposite to the front side of the cylinder block where the outlet of the passage is provided. In this layout, the temperature sensor and harness of the temperature sensor can be easily protected from the heat of the coolant discharged from the outlet of the passage and heat of the exhaust pipe in a case where the exhaust pipe is disposed on the front side of the engine. In addition, the temperature sensor attached on the rear portion of the cylinder block can be easily protected from, for example, stones flying in a rearward direction, during traveling of the straddle-type vehicle.

The inlet of the passage may be disposed at a center of the cylinder head in the vehicle width direction, and the temperature sensor may be disposed at a location that is outward in the vehicle width direction, relative to a center of the cylinder block in the vehicle width direction.

In accordance with this configuration, since the inlet of the passage is disposed at the center of the cylinder head in the vehicle width direction, and the temperature sensor is disposed at the location that is outward in the vehicle width direction, relative to the center of the cylinder block in the vehicle width direction, it becomes possible to easily prevent interference between the temperature sensor and a connection portion of the pipe which is connected to the inlet of the passage, and properly attach the temperature sensor on the cylinder block while simplifying the pipe structure, on the rear side of the engine.

The pipe may be disposed below the upper end portion of the engine. In accordance with this configuration, since the pipe is disposed below the upper end portion of the engine, the pipe is less noticeable than the engine is, when viewed from above. This makes it possible to effectively prevent the external appearance of the straddle-type vehicle from being degraded by the pipe structure.

The engine may be a multi-cylinder engine including a plurality of cylinders aligned in a vehicle width direction, and the pipe may extend along the engine in the vehicle width direction, in a region which is in the vicinity of the inlet of the passage and a region which is in the vicinity of the outlet of the passage, and extend to a first side in the vehicle width direction from the outlet of the passage and to a second side in the vehicle width direction from the inlet of the passage. In accordance with this configuration, since the pipe can be extended along the engine in different directions of the vehicle width direction, the pipe can be efficiently disposed in the forward and rearward direction.

The straddle-type vehicle may further comprise: a pump which flows the coolant into the inlet of the passage, the pipe may include a first pipe and a second pipe, the first pipe may include a front pipe and a rear pipe which are disposed on a same side of a vehicle body in a vehicle width direction, a first end of the front pipe may be connected to the radiator and a second end of the front pipe may be connected to the pump, a first end of the rear pipe may be connected to the pump and a second end of the rear pipe may be connected to the inlet of the passage, in a region which is rearward of the front pipe, and a first end of the second pipe may be connected to the outlet of the passage, and a second end of the second pipe may be connected to a first end the radiator in the vehicle width direction. In accordance with this configuration, since the pipe includes the plurality of members as described above, design flexibility of the pipe can be improved.

In accordance with the above-described straddle-type vehicle, it becomes possible to provide the pipe structure for circulating the coolant between the radiator and the engine via the thermostat so that design flexibility of the straddle-type vehicle can be easily improved and the external appearance of the straddle-type vehicle can be easily maintained, in the straddle-type vehicle including the pipe structure.

The above and further objects, features and advantages of the present invention will more fully be apparent from the following detailed description of preferred embodiment with reference to the accompanying drawings.

DETAILED DESCRIPTION OF THE EMBODIMENTS

Hereinafter, the embodiment of the present invention will be described with reference to the drawings. Throughout the drawings, the same or corresponding constituents are designated by the same reference symbols, and will not be described repeatedly. The stated directions are from the perspective of a rider straddling a motorcycle 1. A vehicle width direction of the vehicle body of the motorcycle 1 corresponds with a rightward and leftward direction of the vehicle body.

Figure 1:
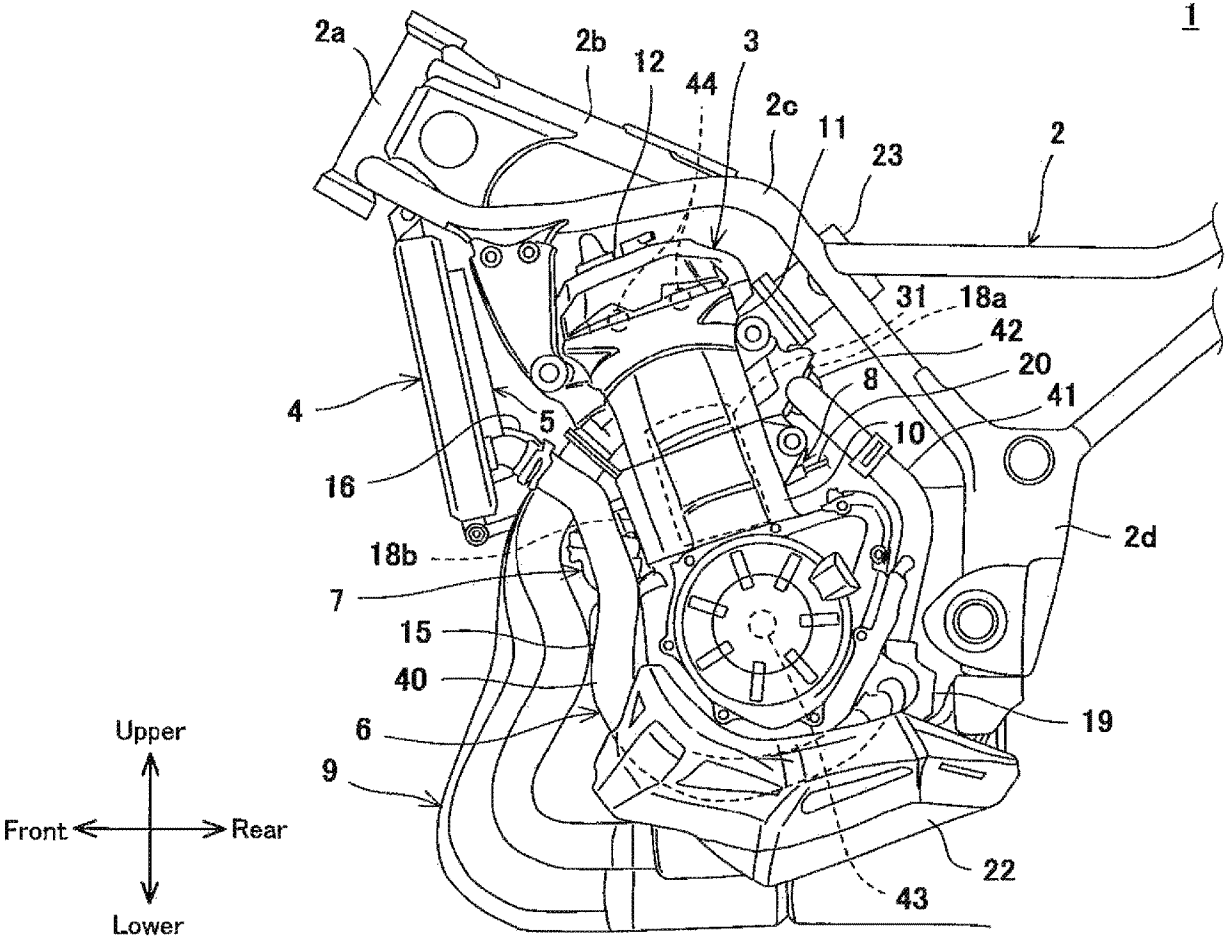
FIG. 1 is a left side view showing the major constituents of a motorcycle according to the embodiment.

FIG. 1 is a left side view showing the major constituents of the motorcycle 1 according to the embodiment. As shown in FIG. 1, the motorcycle 1 is an example of a straddle-type vehicle, and includes a vehicle body frame 2, an engine 3 which generates driving power for allowing the motorcycle 1 to travel, a radiator 4, a fan 5, a pipe unit 6, a thermostat 7, a temperature sensor 8, and an exhaust pipe 9. For example, the motorcycle 1 is of a naked type. The motorcycle of the naked type refers to a motorcycle which does not include a cowling. A side stand is provided on the left side of the motorcycle 1 in the vehicle width direction. When the motorcycle 1 is parked, the motorcycle 1 is tilted to the left in a state in which its vehicle body is supported by the side stand.

The vehicle body frame 2 includes a head pipe 2*a* extending in a vertical direction on the front side of the vehicle body frame 2, a pair of right and left upper frame members 2*b* extending in a forward and rearward direction from the upper portion of the head pipe 2*a*, a pair of right and left lower frame members 2*c* extending in the forward and rearward direction of the vehicle body, from the lower portion of the head pipe 2*a*, at locations that are below the upper frame members 2*b*, respectively, and a pair of right and left pivot frame members 2*d* extending in the vertical direction and connected to the lower frame members 2*c*, respectively, at a center of the vehicle body frame 2 in the forward and rearward direction.

A stem of a steering member is rotatably supported by the head pipe 2*a*. The engine 3 and the radiator 4 are disposed below the lower frame members 2*c*. The lower frame members 2*c* support the engine 3 and the radiator 4. The pivot frame members 2*d* are disposed rearward of the engine 3 and support the engine 3.

The engine 3 is, for example, a multi-cylinder engine (four-cylinder engine in the present embodiment) including a plurality of cylinders 31 aligned in a specified direction, and outputs the driving power for rotating a rear wheel. In the present embodiment, the engine 3 is the multi-cylinder engine including the plurality of cylinders 31 aligned in the vehicle width direction. Alternatively, the engine 3 may be a single-cylinder engine.

The engine 3 includes a cylinder block 10, a cylinder head 11 disposed above the cylinder block 10, and a head cover 12 disposed above the cylinder head 11. A throttle body 23 is connected to the rear portion of the cylinder head 11. A crankshaft 43 is accommodated inside the cylinder block 10 and extends in the vehicle width direction. The cylinders 31 extend in the vertical direction inside the cylinder block 10. A plurality of camshafts 44 are accommodated inside the cylinder head 11 and the head cover 12 and extend in the vehicle width direction.

The air which has flowed through the throttle body 23 and fuel injected from an injector attached on the throttle body 23 are sent to a combustion chamber of the engine 3, from the rear of the cylinder head 11. The engine 3 generates the driving power in such a manner that an ignition (spark) plug attached on the cylinder head 11 is lighted, inside the combustion chamber.

The engine 3 includes a passage 18 (see FIG. 5) provided inside the cylinder block 10 and the cylinder head 11, to flow the coolant from the cylinder head 11 toward the cylinder block 10. An inlet 18*a* of the passage 18 is located on the rear side of the cylinder head 11, while an outlet 18*b* of the passage 18 is located on the front side of the cylinder block 10. A water pump 19 is provided on the left side of the engine 3 in the vehicle width direction. A side cover 22 is provided on the left side of the engine 3 at a location that is below the engine 3 to protect the engine 3.

The radiator 4 is disposed in front of the engine 3, and supported on the lower frame members 2*c*. Air flowing from the front flows through the radiator 4 in the forward and rearward direction. In the radiator 4, a coolant which has cooled the engine 3 flows through the inside, and exchanges heat with the air flowing through the radiator 4. After that, the coolant is supplied to the engine 3. A pair of front forks and a front wheel are disposed in front of the radiator 4. The front wheel is rotatably supported on the pair of front forks. A fan 5 is disposed behind the radiator 4, and forcibly flows the air through the radiator 4.

The pipe unit 6 circulates the coolant between the engine 3 and the radiator 4. The pipe unit 6 flows the coolant from the radiator 4 toward the inlet 18*a* of the passage 18, and from the outlet 18*b* of the passage 18 toward the radiator 4.

The pipe unit 6 extends along the engine 3 in the vehicle width direction, in a region which is in the vicinity of the inlet 18*a* of the passage 18 and a region which is in the vicinity of the outlet 18*b* of the passage 18. In addition, the pipe unit 6 extends to a first side (right side in the present embodiment) in the vehicle width direction from the outlet 18*b* of the passage 18 and extends to a second side (left side in the present embodiment) from the inlet 18*a* of the passage 18.

The pipe unit 6 includes a first pipe 15 and a second pipe 16. A first end of the first pipe 15 is connected to the radiator 4. A second end of the first pipe 15 is connected to the inlet 18*a* of the passage 18. The water pump 19 is provided at an intermediate portion of the first pipe 15. After the coolant has been cooled by the radiator 4, the coolant is sent to the engine 3 through the first pipe 15 by a driving force exerted by the water pump 19, and flows into the inlet 18*a* of the passage 18.

Specifically, the first pipe 15 includes a front pipe 40 and a rear pipe 41 located rearward of the front pipe 40. A first end of the front pipe 40 is connected to the left lower portion of the radiator 4. A second end of the front pipe 40 is connected to the water pump 19. A first end of the rear pipe 41 is connected to the water pump 19. A second end of the rear pipe 41 is connected to the inlet 18*a* of the passage 18 via a connection member 42.

A first end of the second pipe 16 is connected to the outlet 18*b* of the passage 18. A second end of the second pipe 16 is connected to the right lower portion of the radiator 4. The coolant which has cooled the engine 3 is discharged from the outlet 18*b* of the passage 18 and is sent to the radiator 4 through the second pipe 16. The pipe unit 6 is disposed below the upper end portion of the engine 3. In the above-described layout, the pipe unit 6 is not easily seen from the outside region of the motorcycle 1 although the motorcycle 1 is of the naked type.

The thermostat 7 is attached on the front portion of the engine 3. The thermostat 7 is disposed between the first end of the second pipe 16 and the outlet 18*b* of the passage 18. The thermostat 7 is disposed below a vertical center of the radiator 4 (center of the radiator 4 in the vertical direction). The thermostat 7 is disposed below the upper ends of the cylinders 31. The thermostat 7 limits a flow of the coolant inside the pipe unit 6 in a case where the temperature of the coolant is equal to or lower than a predetermined temperature, and permits the flow of the coolant inside the pipe unit 6 in a case where the temperature of the coolant is higher than the predetermined temperature.

The temperature sensor 8 detects the temperature of the coolant flowing through the passage 18 provided inside the cylinder block 10. The temperature sensor 8 is attached on the rear portion of the cylinder block 10. The tip end portion of the temperature sensor 8 is inserted into the cylinder block 10. Harness 20 extends from the rear end portion of the temperature sensor 8. The harness 20 is connected to an ECU included in the motorcycle 1. The temperature detected by the temperature sensor 8 is monitored by the ECU.

The exhaust pipe 9 is connected to the front portion of the engine 3, and extends rearward at a locations that is below the engine 3. The exhaust pipe 9 flows an exhaust gas emitted from the engine 3 toward a muffler. The thermostat 7 is disposed between the cylinder block 10 and the exhaust pipe 9.

Figure 2:
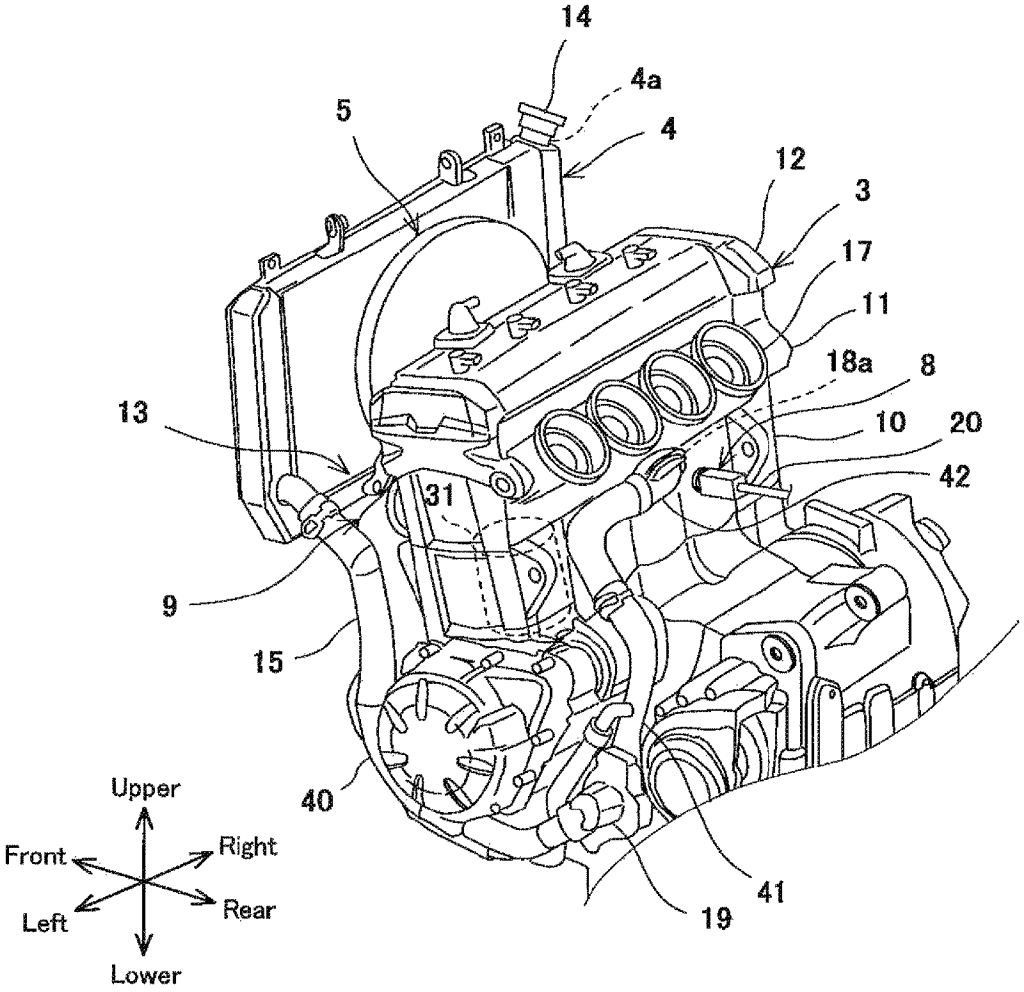
FIG. 2 is a perspective view showing an engine and a radiator of FIG. 1, when viewed from the left and the rear.

FIG. 2 is a perspective view showing the engine 3 and the radiator 4 of FIG. 1, when viewed from the left and the rear. Although FIG. 2 shows only the cylinder 31 located on a leftmost side, the plurality of cylinders 31 are aligned in the engine 3 in such a manner that the cylinders 31 are apart from each other in the vehicle width direction.

As shown in FIG. 2, the inlet 18*a* of the passage 18 is disposed at the center of the engine 3 in the vehicle width direction. In the present embodiment, the inlet 18*a* of the passage 18 is disposed at a location of the cylinder head 11 that overlaps in the forward and rearward direction, with a gap at a center in the vehicle width direction, among a plurality of gaps each of which is formed between adjacent cylinders 31. A plurality of (four in the present embodiment) ducts 17 connected to the throttle body 23 are aligned on the rear side of the cylinder head 11 in such a manner that the ducts 17 are apart from each other in the vehicle width direction. The inlet 18*a* of the passage 18 is disposed below the ducts 17. On the left side of the engine 3, the rear pipe 41 extends upward from the water pump 19. Then, the rear pipe 41 is bent in the vehicle width direction at a location that is below the leftmost duct 17, and is connected to the inlet 18*a* of the passage 18 via the connection member 42.

The temperature sensor 8 is disposed at a location that is outward (rightward in the present embodiment) in the vehicle width direction, relative to the center of the cylinder block 10 in the vehicle width direction. The radiator 4 extends in the vertical direction and in the vehicle width direction. The radiator 4 has a rectangular parallelepiped shape in which a dimension in the forward and rearward direction is smaller than a dimension in the vehicle width direction. The radiator 4 is disposed in front of the engine 3 with a space 13 between the radiator 4 and the engine 3.

The radiator 4 includes an inlet 4*a* through which the coolant which has cooled the engine 3 flows into the radiator 4, and a radiator cap 14 covering the inlet 4*a*. The inlet 4*a* is disposed on the first side (right side in the present embodiment) of the radiator 4 in the vehicle width direction. The inlet 4*a* is in communication with the interior of the radiator 4. The coolant supplied from a reservoir tank attached on the motorcycle 1 is sent to the radiator 4 through the inlet 4*a* and refills the radiator 4.

Figure 3:
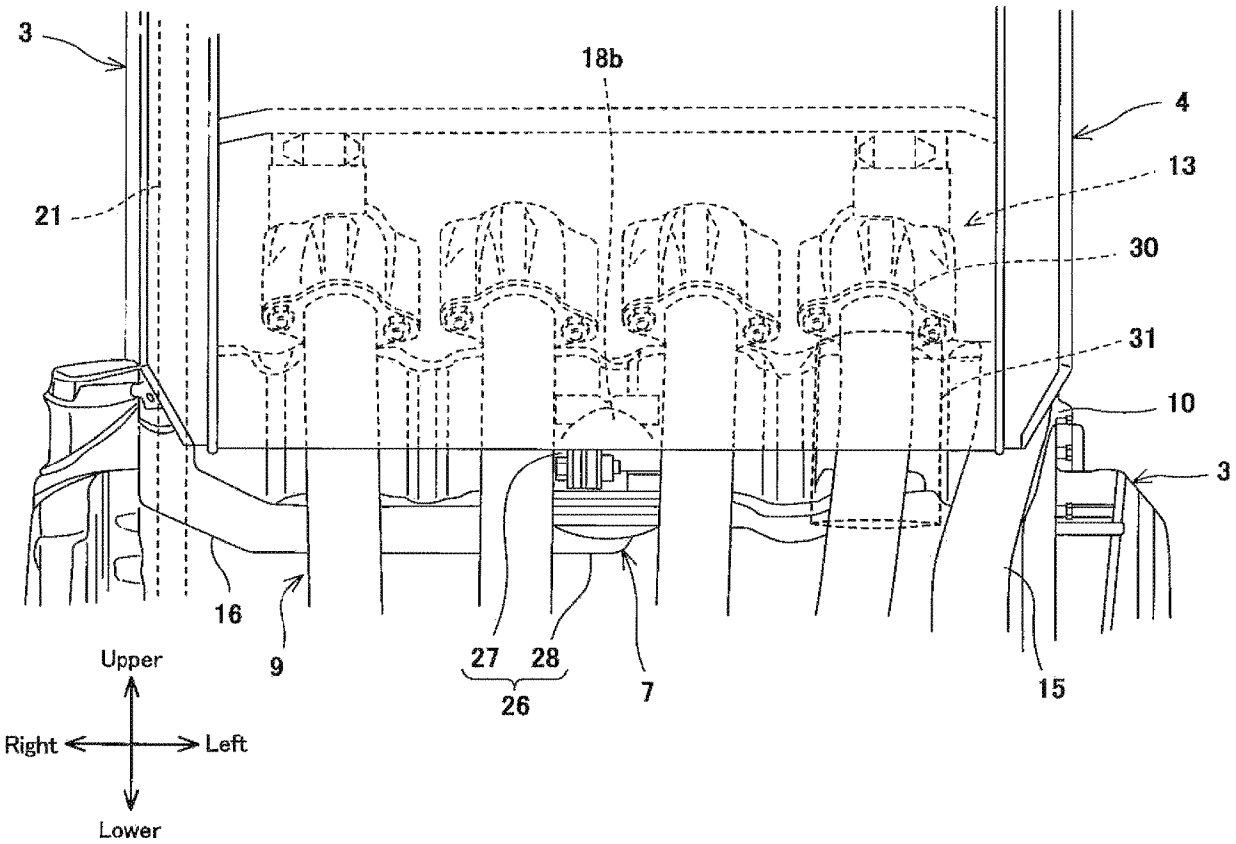
FIG. 3 is a front view of the engine and the radiator of FIG. 1.

FIG. 3 is a front view of the engine 3 and the radiator 4 of FIG. 1. In FIG. 3, only the leftmost cylinder 31 is shown. In the present embodiment, the engine 3 is of a side cam chain type. A cam chain 21 is disposed on the first side (right side in the present embodiment) of the engine 3 in the vehicle width direction to drive the camshafts 44. The cam chain 21 extends in the vertical direction and is wrapped around a gear mounted on the crankshaft 43 and gears mounted on the camshafts 44. Through the cam chain 21, the driving power of the crankshaft 43 is transmitted to the camshafts 44.

The outlet 18*b* of the passage 18 is disposed at the center of the engine 3 in the vehicle width direction. In the present embodiment, the outlet 18*b* of the passage 18 is disposed at a location of the cylinder block 10 that overlaps in the forward and rearward direction, with a gap at the center in the vehicle width direction, among the plurality of gaps each of which is formed between adjacent cylinders 31. On the front side of the cylinder block 10, a plurality of (four in the present embodiment) exhaust ports 30 to which a plurality of pipe members of the exhaust pipe 9 are connected, respectively, are arranged side by side in the vehicle width direction. The outlet 18*b* of the passage 18 is located below the exhaust ports 30.

The thermostat 7 is disposed between the cylinder block 10 and the exhaust pipe 9. The second pipe 16 extends in the vehicle width direction and in the forward and rearward direction, in the lower portion of the space 13. In this configuration, the second pipe 16 is not easily seen from the outer region of the motorcycle 1. In addition, a portion of the right side surface of the engine 3 is not covered by the second pipe 16.

When viewed from the front (in a front view), the exhaust pipe 9 extends downward to a location that is below the engine 3, from the front surface of the cylinder block 10. In the motorcycle 1, the thermostat 7 is disposed between the front surface of the cylinder block 10 and the exhaust pipe 9.

Figure 4:
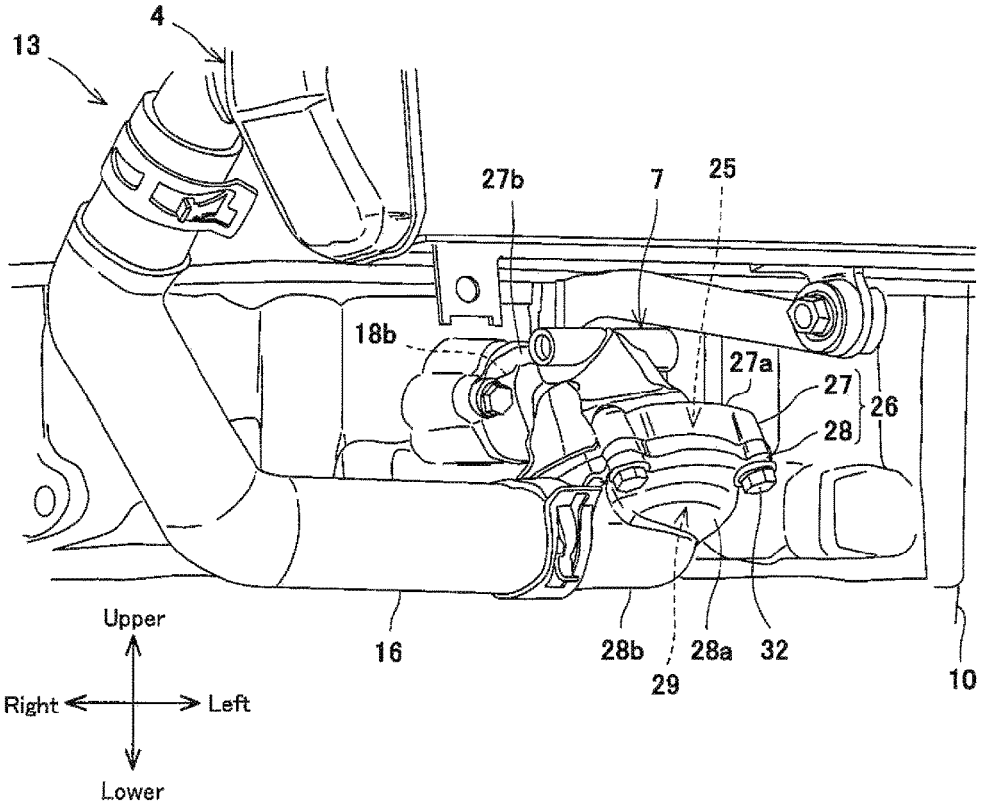
FIG. 4 is a perspective view showing a thermostat of FIG. 1, when viewed from the right and the front.

FIG. 4 is a perspective view showing the thermostat 7 of FIG. 1, when viewed from the right and the front. As shown in FIG. 4, the thermostat 7 includes a valving element 25 and a case 26 accommodating the valving element 25 therein.

A first end of the case 26 is connected to the second pipe 16, while a second end of the case 26 is connected to the outlet 18*b* of the passage 18. The case 26 includes an upper case 27 and a lower case 28. The upper case 27 includes an upper case body 27*a* having a lower opening, and an upstream pipe member 27*b* provided rearward of the upper case body 27*a*. The upper case body 27*a* has a substantially semispherical shape. The inside of the upper case body 27*a* is in communication with the inside of the upstream pipe member 27*b*. The upstream pipe member 27*b* extends in the forward and rearward direction. A first end of the upstream pipe member 27*b* is connected to the outlet 18*b* of the passage 18.

The upstream pipe member 27*b* extends in the forward and rearward direction at a location that is in front of a portion of the cylinder block 10 which overlaps in the forward and rearward direction with the gap formed between adjacent cylinders 31. Because of this configuration, compared to a case where the upstream pipe member 27*b* extends in the forward and rearward direction at a location that is in front of a portion of the cylinder block 10 which overlaps in the forward and rearward direction with the center of the cylinder 31 in the vehicle width direction, the amount of a protruding portion of the thermostat 7 which protrudes forward from the cylinder block 10 is reduced.

The lower case 28 includes a lower case body 28*a* having an upper opening, and a downstream pipe member 28*b* provided below the lower case body 28*a*. The lower case body 28*a* has a substantially semispherical shape. The inside of the lower case body 28*a* is in communication with the inside of the downstream pipe member 28*b*. The lower case body 28*a* is joined to the upper case body 27*a* by use of a plurality of fastening members 32 in a state in which the peripheral edge of the opening of the lower case body 28*a* of the lower case 28 and the peripheral edge of the opening of the upper case body 27*a* of the upper case 27 are butted together. In this way, an inner space 29 with a substantially spherical shape is formed in the case 26.

The downstream pipe member 28*b* extends in a direction (in the vehicle width direction in the present embodiment) crossing the forward and rearward direction, from the front side of the cylinder block 10. More specifically, the downstream pipe member 28*b* extends to the right from the lower portion of the lower case body 28*a*. A first end of the downstream pipe member 28*b* is connected to the second pipe 16.

In a case where the temperature of the coolant which has flowed from the upstream pipe member 27*b* into the inner space 29 of the thermostat 7 is equal to or lower than a predetermined temperature, a flow of the coolant in the inner space 29 of the thermostat 7 is limited. On the other hand, in a case where the temperature of the coolant which has flowed from the upstream pipe member 27*b* into the inner space 29 of the thermostat 7 is higher than the predetermined temperature, a flow of the coolant in the inner space 29 of the thermostat 7 is permitted, and the coolant flows toward the downstream pipe member 28*b*.

Figure 5:
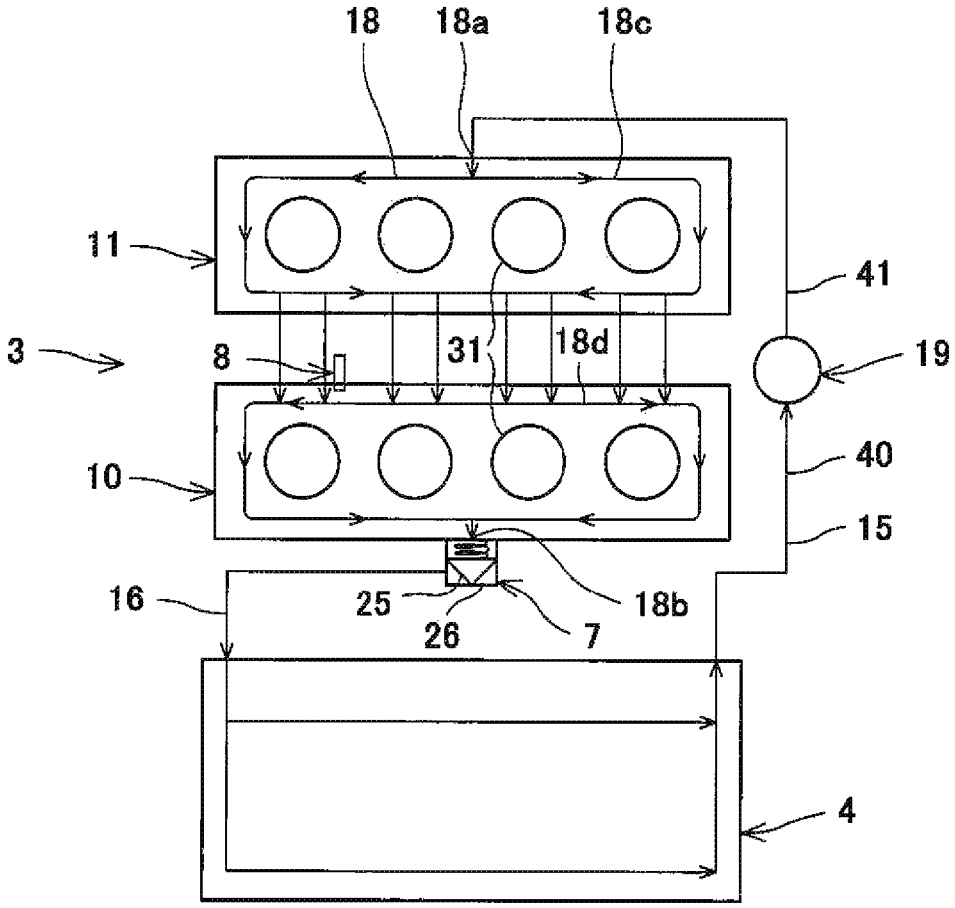
FIG. 5 is a circuit diagram showing circulation of a coolant in the motorcycle of FIG. 1.

FIG. 5 is a circuit diagram showing circulation of the coolant in the motorcycle 1 of FIG. 1. FIG. 5 shows the cylinder block 10, the cylinder head 11, and the water pump 19 in a state in which they are apart from each other. FIG. 5 schematically shows the thermostat 7, the cylinder block 10, the cylinder head 11, and the water pump 19. FIG. 5 shows a vertical section of the radiator 4 which is perpendicular to the forward and rearward direction, a radial cross-section of the cylinders 31 of the cylinder block 10 at a height position at which a cylinder block passage 18*d* is provided, and a radial cross-section of the cylinders 31 of the cylinder head 11 at a height position at which a cylinder head passage 18*c* is provided.

As shown in FIG. 5, inside the engine 3, the passage 18 extends from the inlet 18*a* to the first side (right side in the present embodiment) in the specified direction and to the second side (left side in the present embodiment) in the specified direction, and extends from the outlet 18*b* to the first side and to the second side. The passage 18 includes the cylinder head passage 18*c* and the cylinder block passage 18*d*. The cylinder head passage 18*c* surrounds the upper end portions of the plurality of cylinders 31 inside the cylinder head 11. The cylinder block passage 18*d* surrounds the upper portions of the plurality of cylinders 31 inside the cylinder block 10. The cylinder head passage 18*c* and the cylinder block passage 18*d* are in communication with each other in the vertical direction at a plurality of locations that overlap with the cylinders 31, respectively, in the forward and rearward direction. The cylinder head passage 18*c* has a symmetric shape in the rightward and leftward direction, with respect to the inlet 18*a*. The cylinder block passage 18*d* has a symmetric shape in the rightward and leftward direction, with respect to the outlet 18*b*.

After the coolant has flowed through the radiator 4, the coolant flows through the front pipe 40 and the rear pipe 41 of the first pipe 15 by the driving force exerted by the water pump 19, and flows into the inlet 18*a* of the passage 18. Then, the coolant flows to the right and to the left from the inlet 18*a*, and flows through the cylinder head passage 18*c*. After that, the coolant flows through the cylinder block passage 18*d*.

Since the cylinder head passage 18*c* has a symmetric shape in the rightward and leftward direction, with respect to the inlet 18*a*, and the cylinder block passage 18*d* has a symmetric shape in the rightward and leftward direction, with respect to the outlet 18*b*, the cylinders 31 are cooled uniformly by the coolant flowing through the cylinder head passage 18*c* and the cylinder block passage 18*d*. The coolant is gathered to the center in the vehicle width direction, of the front side of the cylinder block 10, and is discharged from the outlet 18*b* of the passage 18.

The temperature sensor 8 is attached on the rear portion of the cylinder block 10, and is apart from the inlet 18*a* of the passage 18 of the cylinder head 11. In this layout, it becomes possible to suppress the temperature sensor 8 from being thermally affected by the coolant in a low-temperature state which has just flowed into the inlet 18*a* of the passage 18 of the cylinder head 11. This allows the temperature sensor 8 to properly detect the temperature of the coolant flowing through the cylinder block passage 18*d* of the cylinder block 10.

After the coolant has been discharged from the outlet 18*b* of the passage 18, the coolant flows into the thermostat 7. As described above, in a case where the temperature of the coolant is equal to or lower than the predetermined temperature, the flow of the coolant in the inner space 29 of the thermostat 7 is limited. As a result, the flow of the coolant inside the pipe unit 6 is limited.

On the other hand, in a case where the temperature of the coolant is higher than the predetermined temperature, the flow of the coolant in the inner space 29 of the thermostat 7 is permitted. Therefore, the flow of the coolant inside the pipe unit 6 is permitted, and the coolant can flow into the second pipe 16 via the thermostat 7. After the coolant has flowed through the thermostat 7, the coolant is sent to the radiator 4 through the second pipe 16. In the radiator 4, the coolant exchanges heat with the air flowing through the radiator 4. Then, the coolant flows through the first pipe 15 and is sent to the inlet 18*a* of the passage 18 again.

As described above, in the motorcycle 1, since the outlet 18*b* of the passage 18 is provided on the front side of the cylinder block 10 and the thermostat 7 is attached on the front portion of the engine 3, it is not necessary to increase the length of the second pipe 16 connecting the thermostat 7 to the outlet 18*b* of the passage 18, at the front side of the cylinder block 10. In this way, a pipe structure can be simplified. As a result, it becomes possible to easily improve design flexibility of the motorcycle 1, and easily maintain the external appearance of the front side of the cylinder block 10.

Since the thermostat 7 is attached on the front portion of the engine 3, and the thermostat 7 and the second pipe 16 are disposed below the upper and of the engine 3, the thermostat 7 and the second pipe 16 are not easily seen from the outside region of motorcycle 1. Therefore, the external appearance of the motorcycle 1 when viewed from above can be easily maintained. As a result, the pipe structure can be provided in the motorcycle 1 so that the design flexibility of the motorcycle 1 can be easily improved and the external appearance of the motorcycle 1 can be easily maintained.

Since the thermostat 7 is disposed between the cylinder block 10 and the exhaust pipe 9, the downstream pipe member 28*b* of the lower case 28 is connected to the second pipe 16, and the upstream pipe member 27*b* of the upper case 27 is connected to the outlet 18*b* of the passage 18, the thermostat 7 can be placed close to the outlet 18*b* of the passage 18, and thus a space in which the thermostat 7 is placed can be saved. In addition, the case 26 of the thermostat 7 and the outlet 18*b* of the passage 18 can be connected to each other without use of a pipe, and therefore, the pipe structure can be further simplified.

Since the downstream pipe member 28*b* of the lower case 28 extends in the direction crossing the forward and rearward direction, from the front side of the cylinder block 10, the amount of the protruding portion of the case 26 which protrudes forward from the engine 3 can be reduced, and the space 13 formed in front of the engine 3 can be easily secured. In addition, without a need to bend the second pipe 16 to a great degree, the second pipe 16 can be extended in the direction crossing the forward and rearward direction, from the thermostat 7. Therefore, the pipe structure can be easily simplified.

Since the inlet 18*a* and the outlet 18*b* of the passage 18 are disposed at the center of the engine 3 in the vehicle width direction, and the passage 18 extends from the inlet 18*a* to the right and to the left, and extends from the outlet 18*b* to the right and to the left, inside the engine 3, the cylinders 31 can be cooled uniformly by the coolant which flows into the engine 3 through the inlet 18*a* of the passage 18 and is discharged to the outside of the engine 3 through the outlet 18*b* of the passage 18. In this way, uniform cooling effects for the cylinders 31 can be obtained.

Since the temperature sensor 8 is attached on the rear portion of the cylinder block 10, the temperature of the coolant flowing through the passage 18 can be detected with high accuracy, while reducing a variation in the detection value of the temperature sensor 8, which occurs due to the air contacting the front portion of the engine 3, or the temperature of the coolant which has just flowed into the inlet 18*a* of the passage 18. This makes it possible to properly detect the temperature state of the engine 3.

The temperature sensor 8 is attached on the rear portion of the cylinder block 10 which is a side opposite to the front side of the cylinder block 10 where the outlet 18*b* of the passage 18 is provided. In this layout, the temperature sensor 8 and the harness 20 can be easily protected from the heat of the coolant discharged from the outlet 18*b* of the passage 18 and heat of the exhaust pipe 9 in a case where the exhaust pipe 9 is disposed on the front side of the engine 3. In addition, the temperature sensor 8 attached on the rear portion of the cylinder block 10 can be easily protected from, for example, stones flying in a rearward direction, during traveling of the motorcycle 1.

The inlet 18*a* of the passage 18 is disposed at the center of the cylinder head 11 in the vehicle width direction, and the temperature sensor 8 is disposed at a location that is outward in the vehicle width direction, relative to the center of the cylinder block 10 in the vehicle width direction. Therefore, it becomes possible to easily prevent interference between the temperature sensor 8 and a connection portion of the first pipe 15 which is connected to the inlet 18*a* of the passage 18, and properly attach the temperature sensor 8 on the cylinder block 10, while simplifying the pipe structure, on the rear side of the engine 3.

Since the pipe unit 6 is disposed below the upper end portion of the engine 3, the pipe unit 6 is less noticeable than the engine 3 is, when viewed from above. This makes it possible to effectively prevent the external appearance of the motorcycle 1 from being degraded by the pipe structure.

The engine 3 is the multi-cylinder engine including the plurality of cylinders 31 aligned in the vehicle width direction. The pipe unit 6 extends along the engine 3 in the vehicle width direction, in a region which is in the vicinity of the inlet 18*a* of the passage 18 and a region which is in the vicinity of the outlet 18*b* of the passage 18. In addition, the pipe unit 6 extends to the first side in the vehicle width direction from the outlet 18*b* of the passage 18 and to the second side in the vehicle width direction from the inlet 18*a* of the passage 18. In this configuration, the pipe unit 3 can be extend in different directions of the vehicle width direction. As a result, the pipe unit 6 can be efficiently disposed in the forward and rearward direction.

The pipe unit 6 includes the first pipe 15 and the second pipe 16, the first pipe 15 includes the front pipe 40 and the rear pipe 41 which are disposed on the same side of the vehicle body in the vehicle width direction, a first end of the front pipe 40 is connected to the radiator 4 and a second end of the front pipe 40 is connected to the water pump 19, a first end of the rear pipe 41 is connected to the water pump 19 and a second end of the rear pipe 41 is connected to the inlet 18*a* of the passage 18, in a region which is rearward of the front pipe 40, and a first end of the second pipe 16 is connected to the outlet 18*b* of the passage 18, and a second end of the second pipe 16 is connected to a first end of the radiator 4 in the vehicle width direction. Since the pipe unit 6 includes the plurality of members as described above, the design flexibility of the pipe unit 6 can be improved.

The present invention is not limited to the above-described embodiment. The above-described configurations may be changed, added to or deleted from, within a scope of the spirit of the preset invention. The straddle-type vehicle is not limited to the motorcycle and may be other vehicles such as a three-wheeled vehicle, personal watercraft (PWC), a snow mobile, and an all terrain vehicle (ATV). In a case where the straddle-type vehicle is the motorcycle, the motorcycle is not limited to the motorcycle of the naked type and may include the cowling.

Numerous modifications and alternative embodiments of the present invention will be apparent to those skilled in the art in view of the foregoing description. Accordingly, the description is to be construed as illustrative only, and is provided for the purpose of teaching those skilled in the art the best mode of conveying out the invention. The details of the structure and/or function may be varied substantially without departing from the spirit of the invention.

The invention claimed is:

1. A straddle-type vehicle comprising:

a radiator through which a coolant flows;

an engine which generates driving power for allowing the straddle-type vehicle to travel, the engine including:

a cylinder block;

a cylinder head disposed above the cylinder block; and a passage which is provided inside the cylinder block and the cylinder head and flows the coolant from the cylinder head toward the cylinder block, the passage being provided with an inlet located on a rear side of the cylinder head;

a pipe which flows the coolant from the radiator toward the inlet of the passage, and flows the coolant from an outlet of the passage toward the radiator; and a thermostat which limits a flow of the coolant inside the pipe in a case where a temperature of the coolant is equal to or lower than a predetermined temperature, and permits the flow of the coolant inside the pipe in a case where the temperature of the coolant is higher than the predetermined temperature, wherein the outlet of the passage is provided on a front side of the cylinder block and the thermostat is attached on a front portion of the engine.

2. The straddle-type vehicle according to claim 1, further comprising:

an exhaust pipe which is connected to the front portion of the engine and extends downward to a location that is below the engine, from a front surface of the cylinder block, when viewed from a front, wherein the thermostat includes a valving element, and a case which accommodates the valving element therein, wherein the thermostat is disposed between the cylinder block and the exhaust pipe, and wherein a first end of the case of the thermostat is connected to the pipe, and a second end of the case of the thermostat is connected to the outlet of the passage.

3. The straddle-type vehicle according to claim 2, wherein the case of the thermostat extends in a direction crossing a forward and rearward direction of a vehicle body of the straddle-type vehicle, from the front side of the cylinder block.

4. The straddle-type vehicle according to claim 1, wherein the engine is a multi-cylinder engine including a plurality of cylinders aligned in a specified direction, wherein the inlet of the passage and the outlet of the passage are disposed at a center of the engine in the specified direction, and wherein inside the engine, the passage extends from the inlet to a first side in the specified direction and to a second side in the specified direction, and extends from the outlet to the first side and to the second side.

5. The straddle-type vehicle according to claim 1, further comprising:

a temperature sensor which detects a temperature of the coolant flowing through the passage provided inside the cylinder block, wherein the temperature sensor is attached on a rear portion of the cylinder block.

6. The straddle-type vehicle according to claim 1, wherein the inlet of the passage is disposed at a center of the cylinder head in the vehicle width direction, and wherein the temperature sensor is disposed at a location that is outward in the vehicle width direction, relative to a center of the cylinder block in the vehicle width direction.

7. The straddle-type vehicle according to claim 1, wherein the pipe is disposed below an upper end portion of the engine.

8. The straddle-type vehicle according to claim 1, wherein the engine is a multi-cylinder engine including a plurality of cylinders aligned in a vehicle width direction, and wherein the pipe extends along the engine in the vehicle width direction, in a region which is in the vicinity of the inlet of the passage and a region which is in the vicinity of the outlet of the passage, and extends to a first side in the vehicle width direction from the outlet of the passage and to a second side in the vehicle width direction from the inlet of the passage.

9. The straddle-type vehicle according to claim 1, further comprising:

a pump which flows the coolant into the inlet of the passage, wherein the pipe includes a first pipe and a second pipe, wherein the first pipe includes a front pipe and a rear pipe which are disposed on a same side of a vehicle body in a vehicle width direction, wherein a first end of the front pipe is connected to the radiator and a second end of the front pipe is connected to the pump, wherein a first end of the rear pipe is connected to the pump and a second end of the rear pipe is connected to the inlet of the passage, in a region which is rearward of the front pipe, and wherein a first end of the second pipe is connected to the outlet of the passage, and a second end of the second pipe is connected to a first end the radiator in the vehicle width direction.

* * * * *